US009169996B2

(12) United States Patent
Van Gorkom et al.

(10) Patent No.: US 9,169,996 B2
(45) Date of Patent: Oct. 27, 2015

(54) LUMINAIRE HAVING A SET OF LAMELLAE

(75) Inventors: Ramon Pascal Van Gorkom, Eindhoven (NL); Michel Cornelis Josephus Vissenberg, Eindhoven (NL); Ludovicus Johannes Lambertus Haenen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 462 days.

(21) Appl. No.: 13/582,416

(22) PCT Filed: Feb. 25, 2011

(86) PCT No.: PCT/IB2011/050801

§ 371 (c)(1),
(2), (4) Date: Sep. 1, 2012

(87) PCT Pub. No.: WO2011/107914

PCT Pub. Date: Sep. 9, 2011

(65) Prior Publication Data

US 2012/0327653 A1 Dec. 27, 2012

(30) Foreign Application Priority Data

Mar. 3, 2010 (EP) ..... 10155314

(51) Int. Cl.

| | |
|---|---|
| ***F21V 13/04*** | (2006.01) |
| ***F21V 5/04*** | (2006.01) |
| ***F21V 7/05*** | (2006.01) |

(Continued)

(52) U.S. Cl.

CPC . *F21V 13/04* (2013.01); *F21V 5/04* (2013.01); *F21V 5/045* (2013.01); *F21V 7/0025* (2013.01); *F21V 7/05* (2013.01); *F21V 9/10* (2013.01);

(Continued)

(58) Field of Classification Search

CPC ..... F21V 5/008; F21V 5/04; F21V 5/045; F21V 7/0025–7/0041; F21V 7/05; F21V 7/0008; F21V 9/10; F21V 11/02; F21V 11/14; F21V 13/04

USPC ..... 362/223–224, 217.02–217.09, 362/235–248, 268, 307–309, 326–329, 362/608–610

See application file for complete search history.

(56) References Cited

U.S. PATENT DOCUMENTS 5,005,931 A * 4/1991 Mori ..... 385/33
5,988,841 A * 11/1999 Simon ..... 362/551

(Continued)

FOREIGN PATENT DOCUMENTS

CN 1965194 A 5/2007
EP 0733850 A2 9/1996

(Continued)

*Primary Examiner* — Anh Mai
*Assistant Examiner* — Nathaniel Lee
(74) *Attorney, Agent, or Firm* — Meenakshy Chakravorty

(57) ABSTRACT

A luminaire comprising lamellae holding means, a light source, and a set of lamellae comprising a plurality of (inclined) lamellae. The set of lamellae extends at least partially over a light emission window. The lamellae have a reflective front surface facing towards the light source, said front surface being designed to partially reflect light to the exterior and partially transmit light, for example in that the lamellae are diffusely translucent or have a perforated surface. The set of lamellae is provided with light converging means, for example a Fresnel lens, which optionally are integrated in the lamellae to prevent the luminaire becoming too bulky.

14 Claims, 4 Drawing Sheets

(51) Int. Cl.

| | |
|---|---|
| ***F21V 9/10*** | (2006.01) |
| ***F21V 11/14*** | (2006.01) |
| *F21V 13/02* | (2006.01) |
| *F21V 7/00* | (2006.01) |
| *F21Y 101/02* | (2006.01) |

(52) U.S. Cl.
CPC ..... *F21V 11/14* (2013.01); *F21V 7/0008* (2013.01); *F21Y 2101/02* (2013.01)

(56) References Cited

U.S. PATENT DOCUMENTS

| | | | | |
|---|---|---|---|---|
| 2007/0024191 | A1* | 2/2007 | Chen et al. | 313/512 |
| 2008/0112153 | A1 | 5/2008 | Iwasaki et al. | |
| 2008/0151551 | A1 | 6/2008 | Yang et al. | |
| 2009/0141490 | A1 | 6/2009 | Tsai | |
| 2009/0273735 | A1 | 11/2009 | Yeh | |

FOREIGN PATENT DOCUMENTS

| | | | |
|---|---|---|---|
| GB | 2229291 | A | 9/1990 |
| JP | 2001243821 | A | 9/2001 |
| JP | 2005259474 | A | 9/2005 |
| JP | 2006222030 | A | 8/2006 |
| JP | 2008243409 | A | 10/2008 |
| JP | 2009088054 | A | 4/2009 |
| JP | 2010001604 | A | 1/2010 |
| KR | 2009083546 | | 8/2009 |
| WO | 03038336 | A1 | 5/2003 |

* cited by examiner

LUMINAIRE HAVING A SET OF LAMELLAE

FIELD OF THE INVENTION

The invention relates to a luminaire comprising at least one electrical contact for accommodating at least one light source;

a set of lamellae held by lamellae holding means which are arranged adjacent and/or opposite a light exit window, the set of lamellae comprising a plurality of lamellae in an inclined position with respect to the light emission window, the set of lamellae extending at least partially alongside the light emission window;

each lamella having a front surface facing towards a respective light source, said front surface being designed to partially intercept light and direct the intercepted light via the light emission window to the exterior, and to partially transmit light and allow light originating from said respective light source to propagate further alongside the light emission window.

The invention further relates to a louver.

BACKGROUND OF THE INVENTION

Such a luminaire is known from KR2009083546. The known luminaire has a high-brightness LED illumination module as the light source to obtain uniform luminance of the plurality of reflecting lamellae. The lamellae holding means is embodied as a concave reflector for gathering the light and is installed in the longitudinal direction as an inner side of a housing. The lamellae are provided in a row in an inclined orientation alongside a longitudinal direction of the luminaire inside a space enclosed by the housing. Especially for luminaries having high brightness light sources, said uniform luminance is difficult to obtain. In the known luminaire said uniform luminance is obtained by an increased size of each lamella more remote from the light source, thus enabling each lamella to intercept part of the light of the diverging light beam that has passed lamellae closer to the light source. A first part of the light emitted by the light source impinges on the reflective surface of the adjacent lamella and is reflected to the exterior through the light emission window. A second part of the light emitted by the light source propagates alongside said adjacent lamella and partially impinges on the next lamella and partially propagates to yet another lamella. It is a disadvantage of the known luminaire that the lamellae are mutually different, as their dimensions increase with increasing distance from the light source lamellae. This has the disadvantage that the luminaire is relatively expensive because relatively much material is required for its construction and because the lamellae have no (same) standard size. It is another disadvantage of the known luminaire that it is relatively bulky, resulting in the additional disadvantage that the known luminaire is relatively difficult to build into false ceilings where only relatively little space is available.

SUMMARY OF THE INVENTION

It is an object of the invention to counteract at least one of the disadvantages of the known luminaire. To this end the luminaire of the type described in the opening paragraph is characterized in that the set of lamellae is provided with light converging means. Light emitting diodes (LEDs) as high brightness light sources are very interesting as LEDs are getting cheaper and more efficient over time. This has enabled LEDs to be used in general lighting, e.g. as light source for a downlight or office luminaries. Yet other high brightness light sources, for example one or more lasers, compact HID lamps or high efficiency incandescent halogen lamps, are also suitable for use in the inventive luminaire. However, the invention will be discussed with LEDs as the light source.

One of the disadvantages of high brightness light sources is that they easily result in non-uniform luminance, while for office applications a light source with a uniform lower brightness is required. One already known way to deal with this is to spread the LEDs inside the luminaire and use remote phosphor or a diffuser to reduce the brightness. The disadvantage however is that this requires the LEDs to be spread out in the luminaire. It is advantageous to keep the LEDs reasonably close together, as this reduces PCB costs and allows the use of standard LED modules, while it is still possible to make a low brightness source. The advantage of this is that the costs can be lowered by using standard available LED modules, thereby also making the system modular. In the luminaire according to the invention the LEDS can be kept close together, using a high brightness light source emitting a relatively collimated beam of light and using semi-transparent or structured lamellae together with a converging means to redirect and redistribute the light and hence reduce the brightness. In the luminaire of the invention, the light source, for example one or more LEDs with collimator(s), illuminates the set of lamellae that are at an inclined position with respect to the light emission window and the main direction of the (collimated) light beam, for example at an angle $\alpha$ of (about) 45 degrees. Each of the lamellae reflects part of the light downwards through the light emission window to the exterior and transmits the rest of the light. This can for example be achieved by making them semi-transparent, or by making the lamellae fully reflective and simultaneously provide them with at least one through hole, or the lamellae are transmissive and partly covered by a reflective coating. Preferably, the last lamella, i.e. the lamella most remote from its respective light source, is fully reflective; thus it is attained that substantially all the light from the light source is issued to the exterior. By using this lamellae structure the brightness of the source is lowered by the division between the different lamellae. A further brightness reduction can be achieved if the lamellae are semi-diffusely translucent, diffusely translucent and/or reflective; preferably this causes a limited, controlled beam broadening (rather than Lamebrain scattering) and is only applied to the light that is reflected, not to the light that is transmitted. This controlled beam broadening can be achieved by making the lamellae from reflective material with holes, which reflective material is slightly diffusing. The converging means provided to the set of lamellae prevents the light beam from diverging too much and hence obviates the need for lamellae that become too large to intercept and reflect the rays of the light beam downwards. It is thus made possible to provide the luminaire with lamellae that all have about the same magnitude, i.e. have mutual dimensions (or size) that do not differ more than 20%, or even differ less than 10% or 5%, or the dimensions could be the same, thus minimizing costs and simplify manufacturing. Experiments showed that for example at 2 meters below the luminaire a good uniform distribution of the light is obtained, and in the intensity plot it is shown that the light is indeed collimated.

In an embodiment the converging means are placed in between the lamellae, i.e. in an interdigitated configuration, thus preventing the light rays propagating along the light emission window from mutually spreading at too wide an angle. Preferably each converging means is equally spaced from its neighboring lamellae, thus providing the luminaire with a pleasant appearance. The converging means can be a reflective element, for example one or a plurality of elongated, concave, paraboloidally curved reflectors, or a refractive element, for example one or a plurality of normal lenses or Fresnel lenses. Fresnel lenses are easy-to-manufacture, light-weight flat lenses which require only little material, thus offering the advantage of material savings in the manufacture of the luminaire. It is convenient for the luminaire to comprise a housing.

As a further embodiment, it is also possible to combine the mirror and lens functions into a single element. Here, the element can have, e.g. on the front surface, semi-diffusely reflecting patches while the back surface has a Fresnel lens structure. Thus, a relatively simple, light-weight and compact lamellae structure is enabled.

The direction of the beam issued by the luminaire can be adjusted by tilting the lamellae. Preferably each lamella is tiltable independently of other lamellae with respect to the light emission window in an angle range of $\alpha$, for example, 35° to 55°, thus enabling further control of beam shape and beam direction of light issuing from the luminaire. The beam width and beam shape may be further adjusted by replacing the lamellae with lamellae that have different (e.g. asymmetric) scattering properties, or by shifting lamellae with respect to each other, such that (most of the) light hits a different region on the lamella with different scattering properties, for example by aligning or de-aligning the perforation patterns of neighboring lamellae.

Instead of essentially elongated linear luminaries with a set of substantially flat lamellae, use can be made of square, hexagonal, or circularly symmetric luminaries with annular lamellae structures. In these embodiments the LEDs can be positioned at the outer circle (outer wall) of the luminaire and/or alternatively and more preferably in the inner circle (centre) of the luminaire. In the circularly symmetric system with the LEDs in the center, the lamellae at a larger radius will generally produce a more collimated beam, for geometrical optics reasons. This effect may be compensated by varying the diffusion properties of the lamellae as a function of the radius. Alternatively, the effect may be used to control the beam width or beam shape: by varying the transmission properties, for example in that the transmissibility of the lamellae decreases with increasing distance from the respective light source, for example by adjusting the perforation patterns, i.e. by mechanically opening or closing holes in a reflecting lamella, the light may be shifted from the center to the outside of the circle, thereby increasing the degree of collimation. Of course, these ways of controlling the beam width or shape or luminance appearance of the lamellae applies as well to square or elongated luminaries, for example rectangular or elliptic luminaries.

In an embodiment the luminaire is characterized in that the lamellae holding means is chosen from the group consisting of a (tension) wire, a (removable) rim, a housing, a (parabolic) reflector. This enables the luminaire to consist of only the electrical contact, and a set of lamellae kept in place by wires under tension, or by a rigid rim to which optionally the light source, and/or a (parabolic) reflector and/or a housing can be added. The advantage is that the luminaire is light and transparent and that, by removing the rim or loosening the tension on the wires, the lamellae can be folded or stacked together, which makes the luminaire foldable and/or very compact for transportation. Another advantage of such "foldable" luminaries without fixed back reflector/housing is that the number of lamellae or the spacing may be varied, such that a luminaire of variable size may be achieved.

Various alternative embodiments are possible, for example the use of LEDs of any color, or diffuse or semi-diffuse reflectance of the lamellae, or some kind of remote phosphor system, for example a phosphor layer on the front surface of the lamellae, using blue or UV LEDs as the excitation radiation. The phosphor layer, upon being radiated by the UV or blue radiation from the light source, (partially) converts said radiation into longer wavelength radiation, resulting, for example, in white light to be issued by the luminaire.

In embodiments in which the luminaire comprises a housing, the main reflector and the housing may be separate parts, but alternatively may be integrally formed as one part, for example in that the main reflector simultaneously acts as housing.

The invention further relates to a louver suitable for being provided in the luminaire according to the invention, which louver comprises, in one integral unit, the set of lamellae and converging means, said set of lamellae and converging means having all the characteristics of the lamellae and converging means as described above.

BRIEF DESCRIPTION OF THE EMBODIMENT

The invention now will be further elucidated by means of the schematic drawings in which, FIG. 1 shows a longitudinal cross section of a luminaire according to the prior art;

DETAILED DESCRIPTION OF THE EMBODIMENTS

Figure 1:
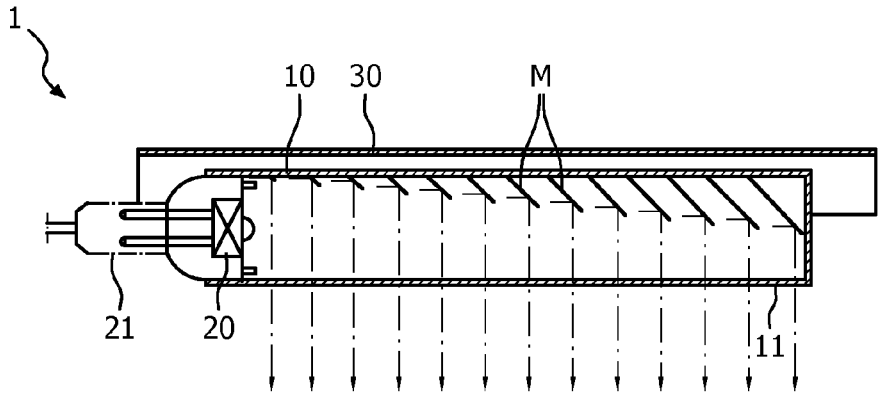

In FIG. 1 a longitudinal cross section of a luminaire 1 according to the prior art is shown. The luminaire comprises a housing 30 in which a light source 20 accommodated in an electric contact 21, a main reflector and lamellae M are arranged. A light source 20, being a LED in the Figure, illuminates a row of lamellae M suspended from a lamellae holding means 10, in the known luminaire embodied as main reflector 10. The size of the lamellae M increases with the distance from the light source 20, and the lamellae partly intercept light and subsequently direct/reflect said intercepted light via a light emission window 11 to the exterior.

Figure 2:
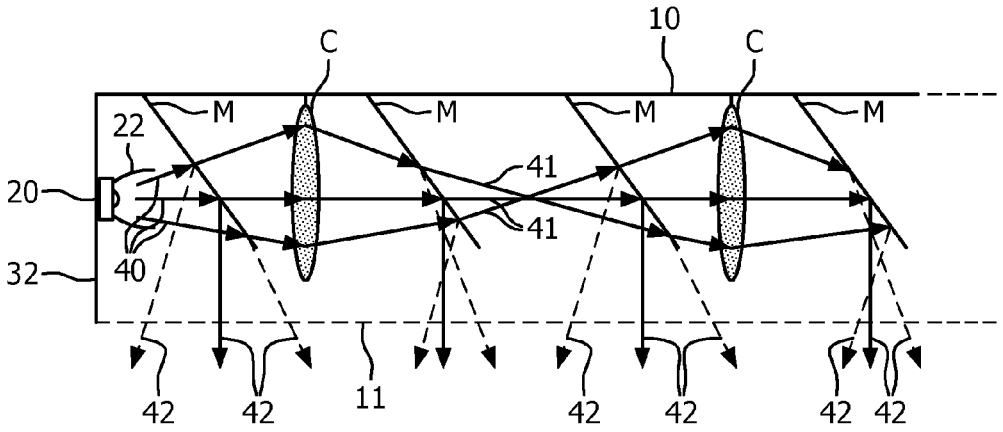
FIG. 2 shows a cross sectional side view of a first embodiment of a luminaire according to the invention.

In FIG. 2 a cross sectional side view of a first embodiment of a part of a luminaire according to the invention is shown. The luminaire comprises rigid, removable rims 10 (of which only one is shown) as lamellae holding means opposite to a light emission window 11. Inside the luminaire a respective light source 20, being a plurality of LEDs with respective collimators 22, is arranged at the outer side wall 32 of a (removable) housing of the luminaire. A set of lamellae M and converging means C, in the Figure a plurality of refracting glass lenses, are suspended from the rims 10 to intercept, reflect and/or converge a collimated beam of light 40 as emitted by the LEDs. The lamellae M are partially reflective to allow light rays 41 to propagate through the lamellae and thus reach lamellae more remote from the light source. The reflected light 42 is issued to the exterior through the light emission window 11.

Figure 3A:
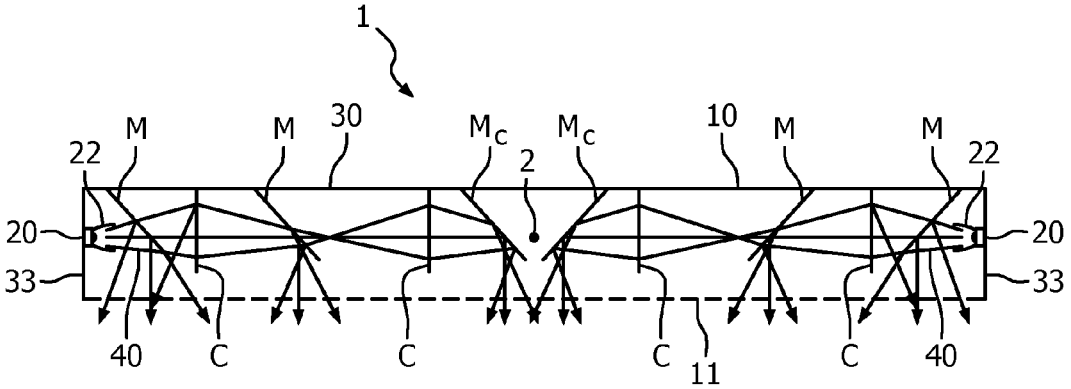
FIG. 3A shows a cross sectional side view of a second embodiment of a part of a luminaire according to the invention.

FIG. 3A shows a cross sectional side view of a second embodiment of a part of a circular luminaire 1 according to the invention around luminaire center 2. Light sources 20 are arranged at an outer annular wall 33 of the luminaire. The light sources 20 which are each provided with a collimator 22 each issue a collimated beam of light 40, which beams are intercepted by the set of lamellae M. The lamellae are in an interdigitated configuration with converging means C, in the Figure a set of (annular) Fresnel lenses. Interdigitated means that the lamellae and the converging means (lenses) are arranged in alternating order viewed in a direction from the light source towards the luminaire center. The light beam, which, after partially passing through a lamella, has become somewhat diverged (or diffused), is converged by the converging means and more or less focused on the next/following lamella. All the lamellae are partially light-reflective, partially light-transmitting, except for the lamellae Mc adjacent the luminaire center 2, which lamellae Mc are fully reflective. The reflected light is issued through a light emission window 11 to the exterior. The luminaire further comprises a housing 30 which simultaneously is a main reflector 10 and which is substantially positioned opposite the light emission window. The set of lamellae M and lenses C are held/fixed in the main reflector 10 inside the housing of the luminaire.

Figure 3B:
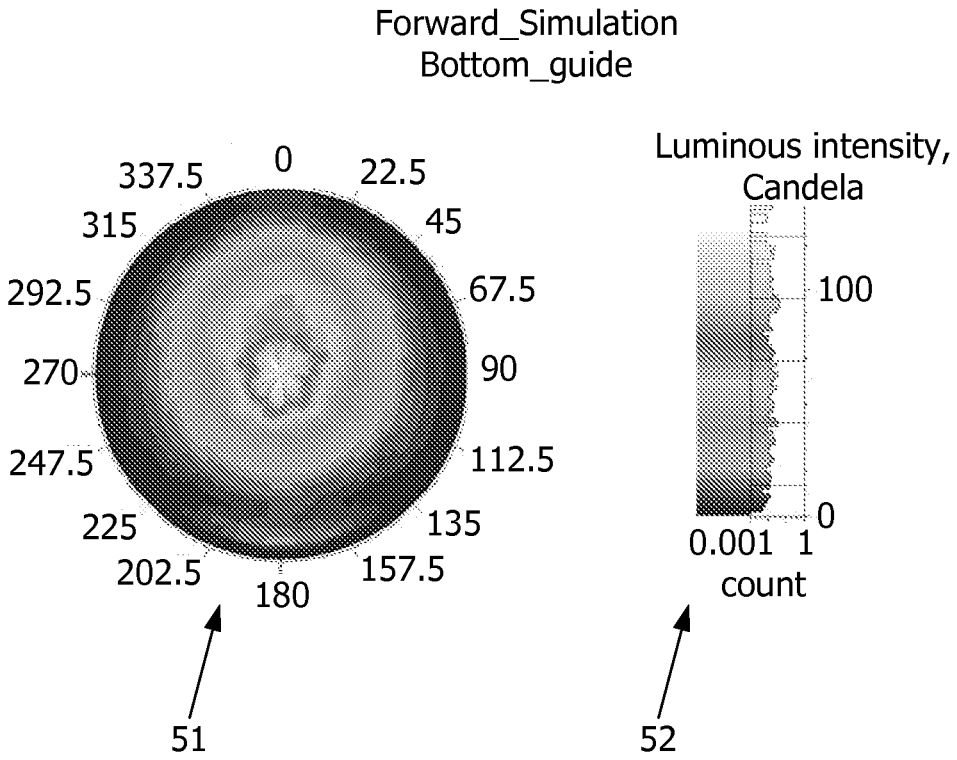
FIG. 3B shows a calculated illuminance plot as obtained by the luminaire of FIG. 3A.

FIG. 3B shows a calculated illuminance plot as obtained by the luminaire of FIG. 3A at two meters distance (below) from said luminaire. By means of the combination of the light distribution plot 51, shown on the left of FIG. 3B, and the luminance intensity plot 52, shown on the right of FIG. 3B, it is shown that collimated light with uniform illuminance is issued by the luminaire.

Figure 4A:
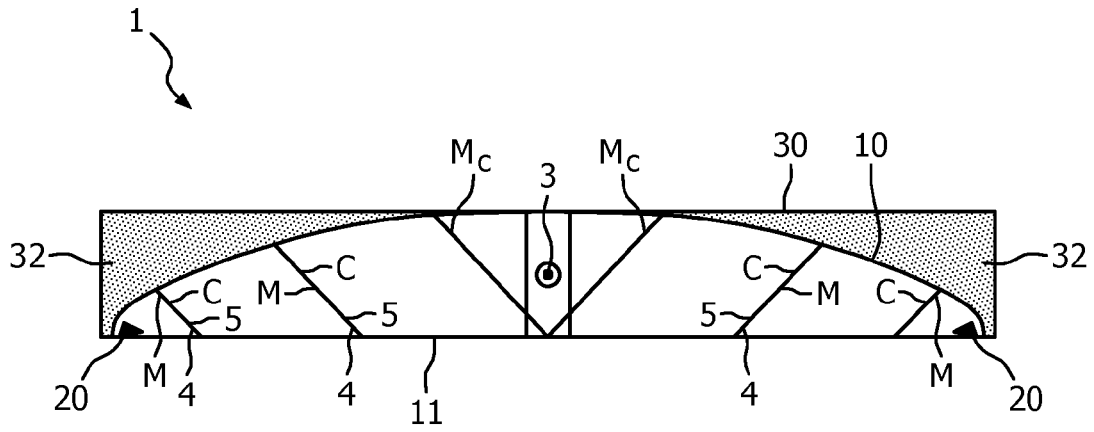
FIG. 4A shows a cross sectional side view of a third embodiment of a luminaire according to the invention.
Figure 4B:
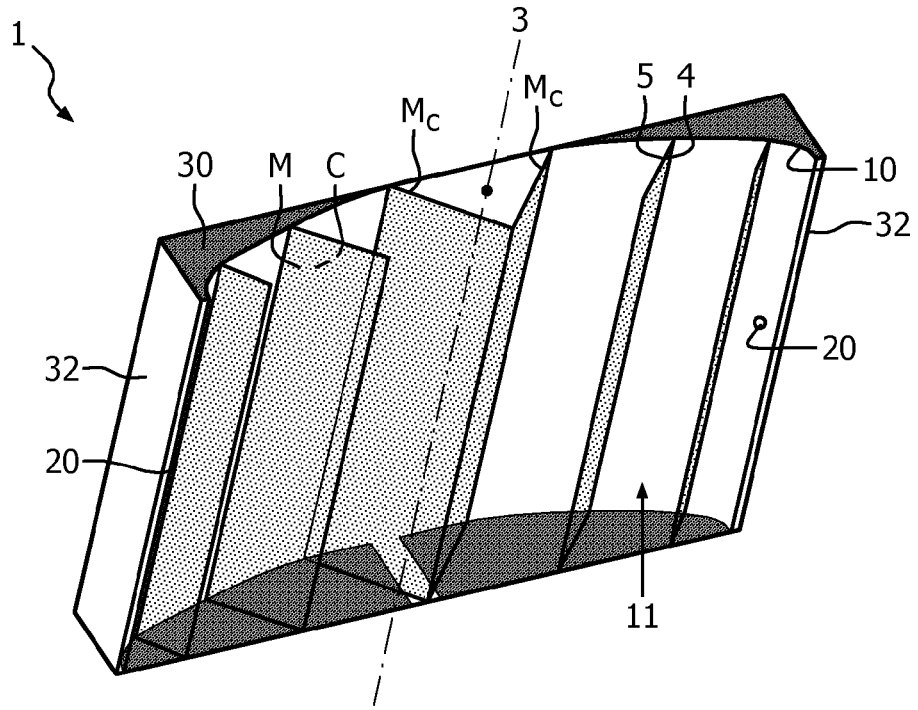
FIG. 4B shows a perspective view of the luminaire of FIG. 4A.

FIGS. 4A and 4B respectively show a cross sectional side view and a perspective view (in a direction through the light emission window 11 towards the main reflector 10) of a third embodiment of a luminaire 1 according to the invention. Light sources 20 are arranged adjacent an outer wall 32 of the luminaire. The light sources 20 each issue a collimated beam of light during operation, which beams are intercepted by the set of lamellae M. The lamellae are integrated with converging means C, i.e. in the Figure a set of Fresnel lenses. The lamellae are partially reflective on a front side 4 facing towards their respective light source, i.e. the light source on the same side as the lamellae with respect to a central line 3 of the luminaire, and are provided with converging means on a back side 5 facing away from their respective light source. The collimated light beam, which, after partially passing the front side of a lamella, has become somewhat diverged (or diffused), is again collimated as a result of the converging means being integrated in the back side of the lamella. All the lamellae are partially light-reflective, partially light-transmitting, except for the lamellae Mc adjacent the luminaire central line 3, which lamellae Mc are fully reflective. The reflected light is issued through the light emission window 11 to the exterior. The luminaire further comprises, in cross-sectional view, a paraboloidally curved main reflector 10 in a housing 30, which main reflector is substantially positioned opposite the light emission window 11. The set of lamellae M are held inside the housing of the luminaire by the main reflector 10.

Figure 4C:
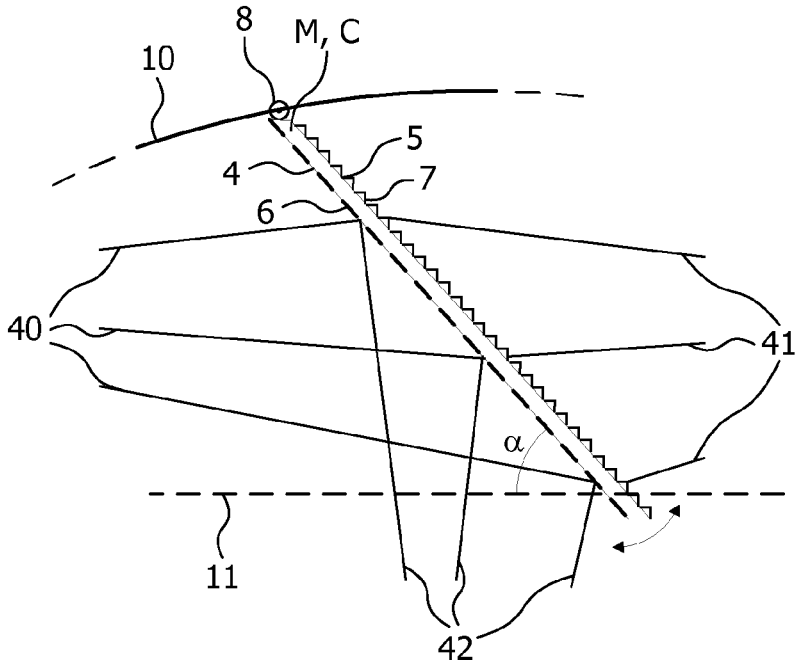
FIG. 4C shows a detail of the luminaire of FIG. 4A.

FIG. 4C shows a cross-section of a partially reflective and converging lamella M, C of the luminaire of FIG. 4A, in particular a reflective layer 6 on the front side 4 and a Fresnel lens structure 7 on the back side 5. The lamella is suspended from the main reflector 10 and adjustably tiltable via a hinge 8. Hence, via hinge 8 an angle $\alpha$ between the light emission window 11 and the orientation of the lamella, and the angle of incidence of light rays 40 is thus controllable. In the Figure, the angle $\alpha$ is about 50°, $\alpha$ being adjustable in a range of 25° to 65°. The orientation of the lamella influences both the direction of reflected light rays 42 which are issued through the light emission window to the exterior and of transmitted light rays 41. Hence the illuminance pattern of the light (beam) as issued by the luminaire is controllable.

Figure 4D:
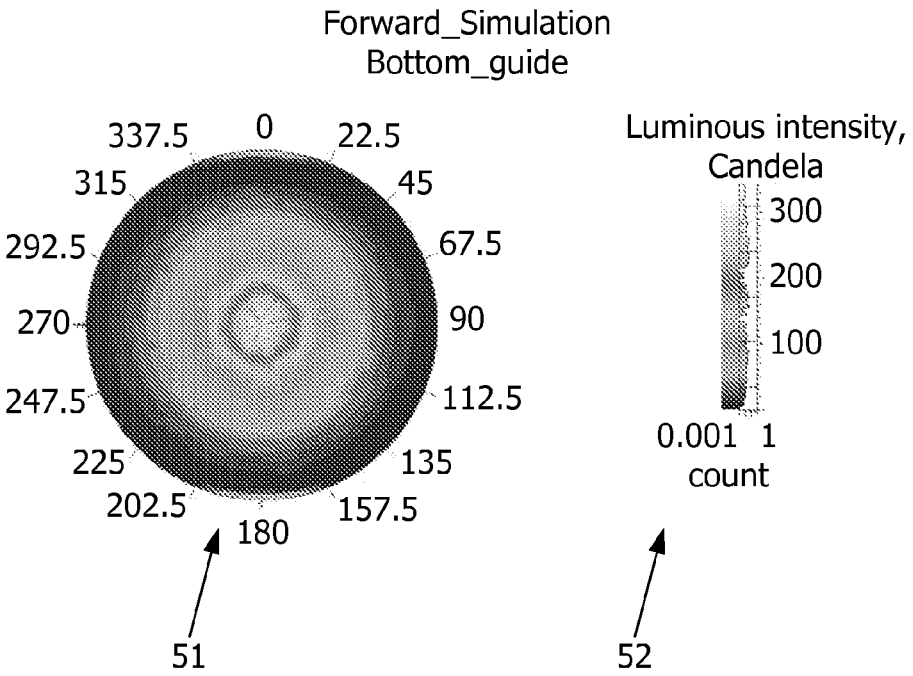
FIG. 4D shows a calculated illuminance plot as obtained by the luminaire of FIG. 4A.

FIG. 4D shows a calculated illuminance plot as obtained by the luminaire of FIG. 4A at two meters distance (below) from said luminaire. By the combination of the light distribution plot 51, shown on the left of FIG. 4D, and the luminance intensity plot 52, shown on the right of FIG. 4D, it is shown that collimated light with uniform illuminance is issued by the luminaire.

The invention has mainly been described hereinabove with reference to a few embodiments. However, as is readily appreciated by a person skilled in the art, embodiments other than the ones disclosed above are equally possible within the scope of the invention, as defined by the appended patent claims.

The invention claimed is:

1. A luminaire, comprising:

at least one electrical contact for accommodating at least one light source;

a set of lamellae held by lamellae holding means which are arranged adjacent and/or opposite a light exit window, the set of lamellae comprising a plurality of lamellae in an inclined position with respect to the light emission window, the set of lamellae extending at least partially alongside the light emission window and light converging means;

each lamella having a front surface facing towards a respective light source, said front surface being designed to partially intercept light and direct the intercepted light via the light emission window to the exterior, and to partially transmit light and allow light originating from said respective light source to propagate further alongside the light emission window wherein the converging means are integral with the lamellae;

wherein the front surface is provided with semi-diffusive patches, and in that the lamellae have a back surface facing away from the respective light source, which back surface is provided with a Fresnel lens structure.

2. Luminaire as claimed in claim 1, wherein the light converging means and the lamellae are arranged in an interdigitated configuration.

3. Luminaire as claimed in claim 1, wherein the converging means is at least one refractive element comprising a Fresnel lens.

4. Luminaire as claimed in claim 1, wherein the reflectance of the lamellae is diffusive or semi-diffusive.

5. Luminaire as claimed in claim 1, wherein the lamellae are reflective and are provided with at least one through hole or the lamellae are transmissive and partly covered by a reflective coating.

6. Luminaire as claimed in claim 5, wherein when the lamellae have the at least one through-hole, the at least one through-hole is embodied as a perforation pattern.

7. Luminaire as claimed in claim 1, wherein the lamellae are provided on the front surface with a phosphor coating.

8. Luminaire as claimed in claim 1, wherein the lamellae have a transmissibility which decreases with increasing distance of the lamellae from the respective light source.

9. Luminaire as claimed in claim 1, wherein a lamella most remote from its respective light source is essentially fully reflective.

10. Luminaire as claimed in claim 1, wherein the lamellae each are of substantially the same magnitude.

11. Luminaire as claimed in claim 1, wherein the lamellae are adjustably tiltable with respect to the light emission window.

12. Luminaire as claimed in claim 1, wherein the lamellae holding means is chosen from the group consisting of a tension wire, a removable rim, a housing, a parabolic main reflector.

13. A luminaire, comprising:

at least one electrical contact for accommodating at least one light source;

a set of lamellae retained in the luminaire which are arranged adjacent and opposite a light exit window;

the set of lamellae including a plurality of lamellae in an inclined position with respect to the light emission window, the set of lamellae extending at least partially alongside the light emission window; and light converging means;

each lamella having a front surface facing towards a respective light source, said front surface being designed to partially intercept light and direct the intercepted light via the light emission window to the exterior and to partially transmit light and allow light originating from said respective light source to propagate further alongside the light emission window;

wherein the light converging means are directly adjacent a back surface of the lamellae;

wherein the front surface of the lamellae is provided with semi-diffusive material, and the lamellae back surface facing away from the respective light source, which back surface is provided with the light converging means.

14. A luminaire, comprising:

at least one electrical contact for accommodating at least one light source;

a set of lamellae retained in the luminaire which are arranged adjacent and opposite a light exit window;

the set of lamellae including a plurality of lamellae in an inclined position with respect to the light emission window, the set of lamellae extending at least partially alongside the light emission window; and light converging structure;

each lamella having a front surface facing towards a respective light source, said front surface being designed to partially intercept light and direct the intercepted light via the light emission window to the exterior and to partially transmit light and allow light originating from said respective light source to propagate further alongside the light emission window;

wherein the light converging structure are directly adjacent a back surface of the lamellae;

wherein the front surface of the lamellae is provided with semi-diffusive material, and the lamellae back surface facing away from the respective light source, which back surface is provided with the light converging structure.

* * * * *